US009842607B2

(12) United States Patent
Shiga

(10) Patent No.: US 9,842,607 B2
(45) Date of Patent: Dec. 12, 2017

(54) SPEECH INTELLIGIBILITY IMPROVING APPARATUS AND COMPUTER PROGRAM THEREFOR

(71) Applicant: National Institute of Information and Communications Technology, Tokyo (JP)

(72) Inventor: Yoshinori Shiga, Tokyo (JP)

(73) Assignee: National Institute of Information and Communications Technology, Tokyo (JP)

( * ) Notice: Subject to any disclaimer, the term of this patent is extended or adjusted under 35 U.S.C. 154(b) by 0 days.

(21) Appl. No.: 15/118,687

(22) PCT Filed: Feb. 12, 2015

(86) PCT No.: PCT/JP2015/053824
§ 371 (c)(1),
(2) Date: Aug. 12, 2016

(87) PCT Pub. No.: WO2015/129465
PCT Pub. Date: Sep. 3, 2015

(65) Prior Publication Data

US 2017/0047080 A1 Feb. 16, 2017

(30) Foreign Application Priority Data

Feb. 28, 2014 (JP) ..... 2014-038786

(51) Int. Cl.
*G10L 21/00* (2013.01)
*G10L 21/0332* (2013.01)
(Continued)

(52) U.S. Cl.
CPC ..... *G10L 21/0332* (2013.01); *G10L 13/033* (2013.01); *G10L 19/0204* (2013.01);
(Continued)

(58) Field of Classification Search
None
See application file for complete search history.

(56) References Cited

U.S. PATENT DOCUMENTS 4,461,024 A * 7/1984 Rengger ..... G10L 15/20 704/207
4,827,516 A * 5/1989 Tsukahara ..... G10L 15/00 704/203
(Continued)

FOREIGN PATENT DOCUMENTS

EP 1 850 328 A1 10/2007
JP 61-286900 A 12/1986
(Continued)

OTHER PUBLICATIONS

International Search report for corresponding International Application No. PCT/JP2015/053824 dated Apr. 7, 2015.
(Continued)

*Primary Examiner* — Marcus T Riley
(74) *Attorney, Agent, or Firm* — Renner, Otto, Boisselle & Sklar, LLP

(57) ABSTRACT

[Object] To provide a speech intelligibility improving apparatus capable of generating highly intelligible speech in various environments without unnecessarily amplifying sound volume.
[Solution] A speech intelligibility improving apparatus 250 includes: an envelope surface extracting unit 292 extracting, from a spectrum of speech signal 254 as an object of processing, a curve representing a general outline of peaks of spectral envelope in contact with or along local peaks of spectral envelope of the spectrum; a noise adapting unit 300 modifying spectrum of speech signal 254 based on the curve extracted by envelope surface extracting unit 292; and a sinusoidal wave speech synthesizing unit 305 generating a
(Continued)

modified speech signal 260 for the speech improved in intelligibility based on the spectrum modified by noise adapting unit 300.

9 Claims, 6 Drawing Sheets

(51) Int. Cl.
*G10L 21/0208* (2013.01)
*G10L 21/007* (2013.01)
*G10L 13/033* (2013.01)
*G10L 19/02* (2013.01)
*G10L 21/0232* (2013.01)
*G10L 25/15* (2013.01)

(52) U.S. Cl.
CPC ..... *G10L 21/007* (2013.01); *G10L 21/0208* (2013.01); *G10L 21/0232* (2013.01); *G10L 25/15* (2013.01)

(56) References Cited

U.S. PATENT DOCUMENTS 6,006,180 A * 12/1999 Bardaud ..... G10L 15/20 704/223
6,993,480 B1 * 1/2006 Klayman ..... G10L 21/0364 704/225
9,117,455 B2 * 8/2015 Tracey ..... G10L 21/003
2003/0055655 A1 * 3/2003 Suominen ..... G10L 15/22 704/276
2008/0312916 A1 12/2008 Konchitsky et al.
2009/0281805 A1 11/2009 LeBlanc et al.

FOREIGN PATENT DOCUMENTS

JP 2003-339651 A 12/2003
JP 2010-055002 A 3/2010

OTHER PUBLICATIONS

T. Zorila, V. Kandia, and Y. Stylianou, "Speech-in-noise intelligibility improvement based on spectral shaping and dynamic range compression" in Proc. Interspeech, Portland Oregon, USA, 2012.
C.H. Taal, R.C. Hendriks, R. Heusdens, "A speech preprocessing strategy for intelligibility improvement in noise based on a perceptual distortion measure", in Proc. ICASSP, pp. 406 1-4064, 20 12.
R.J.McAulay, and T.F.Quatieri, "Speech Analysis/Synthesis Based on a Sinusoidal Representation" IEEE Transaction on Acoustics, Speech, and Signal Processing, vol. ASSP-34, No. 4, Aug. 1986.
Extended European Search Report for corresponding Application No. 15 75 5932.9, dated Jun. 26, 2017.

* cited by examiner

SPEECH INTELLIGIBILITY IMPROVING APPARATUS AND COMPUTER PROGRAM THEREFOR

TECHNICAL FIELD

The present invention relates to speech intelligibility improvement and, more specifically, to a technique of processing a speech signal such that the speech becomes highly intelligible even in a noisy environment.

BACKGROUND ART

When an announcement is made in public places such as train stations and underground shopping malls, actual voices, or recorded or synthesized voices are emitted from a speaker, for example, through a transmission channel. Such a broadcast is to transmit information to the public and, therefore, the information should desirably be correctly transmitted to the public. Sometimes information is transmitted by speeches through an outdoor loudspeaker using an emergency municipal radio communication system, or through a speaker of a municipal sound truck. At the time of a disaster, it is particularly necessary to transmit such information rightly to the public.

It is often difficult, however, to clearly hear and understand the contents of speeches in a public place such as a train station or an underground shopping mall. The reason for this difficulty is surrounding noise and acoustic transmission characteristics of the speaker. Particularly, outdoor transmission of information by speeches is adversely affected by long-path echo, wind and so on. Not only in the public places but also at home, when we listen to the radio or watch television, it is often difficult to clearly hear the speeches because of noise coming from outside and because of household noise.

The simplest solution to such a problem is to turn up (amplify) the volume. Because of the limit of output device performance, however, the volume might not be sufficiently increased, or speech signals might be distorted and become harder to hear when the volume is increased. In addition, speeches in large volume would be unnecessarily loud for neighbors and passers-by, possibly causing a problem of noise pollution.

FIG. 1 shows a typical example of prior art (Non-Patent Literature 1) for improving speech intelligibility without increasing the volume in a bad condition as described above. Referring to FIG. 1, a conventional speech intelligibility improving apparatus 30 receives input of a speech signal 32 and outputs a modified speech signal 34 with improved intelligibility. Speech intelligibility improving apparatus 30 includes: a filtering unit (HPF) 40 mainly passing high-frequency band of speech signal 32 for enhancing high frequency range of voice signal 32; and a dynamic range compression unit (DRC) 42 for compressing dynamic range of waveform amplitude of the signal output from filtering unit 40, so as to make the waveform amplitude uniform in the time direction.

Enhancement of high-frequency-range components of speech signal 32 by filtering unit 40 simulates unique utterance (Lombard speech) used by humans in a noisy environment and, hence, improvement in intelligibility is expected. The degree of enhancement of high-frequency-range components is adjusted continuously in accordance with characteristics of the input speech. On the other hand, dynamic range compressing unit 42 amplifies the waveform amplitude where the volume is locally small and attenuates the amplitude where the volume is large, so that the amplitude of speech waveform becomes uniform. In this manner, the speech becomes relatively more intelligible with indistinct sound reduced, without increasing the overall sound volume.

CITATION LIST

Non Patent Literature

NPL 1: T. Zorila, V. Kandia, and Y. Stylianou, "Speech-in-noise intelligibility improvement based on spectral shaping and dynamic range compression," in Proc. Interspeech, Portland Oreg., USA, 2012.

NPL 2: C. H. Taal, R. C. Hendriks, R. Heusdens, "A speech preprocessing strategy for intelligibility improvement in noise based on a perceptual distortion measure, in Proc. ICASSP, pp. 4061-4064, 2012.

SUMMARY OF INVENTION

Technical Problem

In the existing system shown in FIG. 1, however, perceptual characteristics of speech are not considered in speech processing either by the filtering unit 40 or by the dynamic range compressing unit 42. Therefore, we cannot say that the system based on this prior art uses the optimal method for improving speech intelligibility. Specifically, while the enhancement of high frequency range of speech is based on global inclination of the speech spectrum and the dynamic range compression is based on the amplitude of the speech waveform, the former should be done in consideration of the significance of the spectral peaks such as formants in voice perception, and the latter should be done while paying attention to the fact that the waveform amplitude does not necessarily correspond to the speech power.

Further, this conventional approach does not include any method of adapting speech to noise. Therefore, there is no guarantee that high intelligibility can be maintained in various noisy environments. In other words, it is not always possible to address the changes in ambient noise mixed with the speech.

A proposed solution to this problem is to generate a speech of higher intelligibility even in a noisy environment, by modifying speech spectrum in accordance with the noise characteristics (Non-Patent Literature 2). Constraints on spectrum modification, however, are rather lax and, hence, features essential in speech perception might possibly be modified by such modification of speech spectrum. Excessive modification caused in this manner may lead to undesirable degradation of voice quality, resulting in indistinct speeches.

The present invention was made to solve such problems, and its object is to provide a speech intelligibility improving apparatus capable of synthesizing speeches highly intelligible in various environments, without unnecessarily increasing sound volume.

Solution to Problem

According to a first aspect, the present invention provides a speech intelligibility improving apparatus for generating an intelligible speech, including: peak general outline extracting means for extracting, from a spectrum of a speech signal as an object, a general outline of peaks represented by a curve along a plurality of local peaks of a spectral envelope of the spectrum; spectrum modifying means for modifying the spectrum of the speech signal based on the general outline of peaks extracted by the peak general outline extracting means; and speech synthesizing means for generating a speech based on the spectrum modified by the spectrum modifying means.

Preferably, the peak general outline extracting means extracts, from the spectrogram of a speech signal as an object, a curved surface along a plurality of local peaks of an envelope of the spectrogram in time/frequency domain, and obtains the general outline of peaks at each time from the extracted curved surface.

More preferably, the peak general outline extracting means extracts the general outline of peaks based on perceptual or psycho-acoustic scale of frequency.

More preferably, the spectrum modifying means includes spectrum peak emphasizing means for emphasizing spectrum peaks of the speech signal, based on the general outline of peaks extracted by the peak general outline extracting means.

The spectrum modifying means includes: ambient sound spectrum extracting means for extracting a spectrum from an ambient sound collected in an environment to which the speech is to be transmitted or in a similar environment; and means for modifying a spectrum of the speech signal based on the general outline of peaks extracted by the peak general outline extracting means and the ambient sound spectrum extracted by the ambient sound spectrum extracting means.

According to a second aspect, the present invention provides a computer program causing, when executed by a computer, the computer to function as all means of any of the speech intelligibility improving apparatus described above.

DESCRIPTION OF EMBODIMENTS

Figure 1:
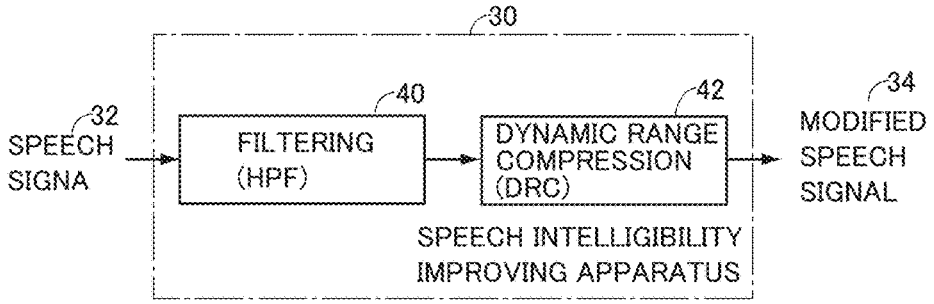
FIG. 1 is a block diagram showing a configuration of a conventional speech intelligibility improving apparatus.

In the following description and in the drawings, the same components are denoted by the same reference characters. Therefore, detailed description thereof will not be repeated. In the following description, basic concepts as a basis of an embodiment will be described first, and then, configurations and operations of the speech intelligibility improving apparatus in accordance with the embodiment will be described.

[1. Basic Concepts]

In the embodiment described in the following, two techniques for improving speech intelligibility are used. One is a technique of speech adaptation to noise characteristics through spectrum shaping based on spectral envelope curve. The other is a technique of thinning out harmonics that do not have much influence to speech perception in noise and re-distributing energy of the thinned-out harmonics to other essential components.

In the present specification, the terms spectral "envelope curve" and "envelope surface" of spectrogram are used. These terms are different from the "spectral envelope" generally used in the art, and also different from mathematical "envelope curve" and "envelope surface." The spectral envelope represents moderate variation in frequency direction with minute structure such harmonics included in speech spectrum removed, and is generally said to reflect human vocal tract characteristics. On the other hand, the "envelope curve" or the curve given as a cross-section at a specific time of the "envelope surface" in accordance with the present invention is a curve drawn in contact with, or close to and along, a plurality of local peaks of formant and the like of the general "spectral envelope" and it is given as more moderate curve than the spectral envelope. In this sense, this may be represented as "envelope of spectral envelope" or a "general outline of peaks of spectral envelope." Here, in order to distinguish the spectral envelope from the "envelope curve" in the present specification, the general "spectral envelope" will be denoted as "spectral envelope" and the curve in contact with local peaks of spectral envelope or the curve drawn along the peaks will be simply referred to as "envelope curve (of spectrum)". The same applies to the "envelope surface" of a spectrogram. In a spectrogram a surface formed by spectral envelope of a spectrum constituting the spectrogram at each time point is referred to as "spectrogram envelope," and the curved surface in contact with local peaks of spectrogram envelope or drawn along the peaks will be simply referred to as "envelope surface (of a spectrogram)." It is noted, however, that the envelope curve or envelope surface may be extracted not through the spectral envelope. A curve represented as a cross-section at specific frequency of the "envelope surface" in accordance with the present specification (time change of spectrum at a certain frequency) is also referred to as an envelope curve here. It is needless to say that the "curve" and "curved surface" here encompass a straight line and a flat surface, respectively.

<1.1 Spectrum Shaping Based on Envelope Curve of Spectrum>

According to the technique of improving speech intelligibility through spectrum shaping based on envelope curve of spectrum, the speech intelligibility is improved through the following steps.

(1) Extracting an envelope surface of speech spectrogram.

(2) Modifying the spectrum to emphasize peaks such as formants of the spectrum, based on said envelope surface.

(3) Modifying speech spectrum and time variation thereof in accordance with the envelope surface of spectrogram.

(4) Further, adding such a modification to speech spectrum that makes the smoothed spectrum of noise becomes parallel to the envelope curve of speech spectrum, for each frame of the spectrogram.

As described above, unlike the conventional method, the present embodiment performs spectrum shaping while taking into consideration the significance of peaks of speech spectrum, such as formants, in speech perception, and simultaneously applies dynamic range compression to the temporal variation of spectrum, which is closely related to the auditory perception.

<1.1.1 Envelope Surface of Spectrogram>

Figure 2:
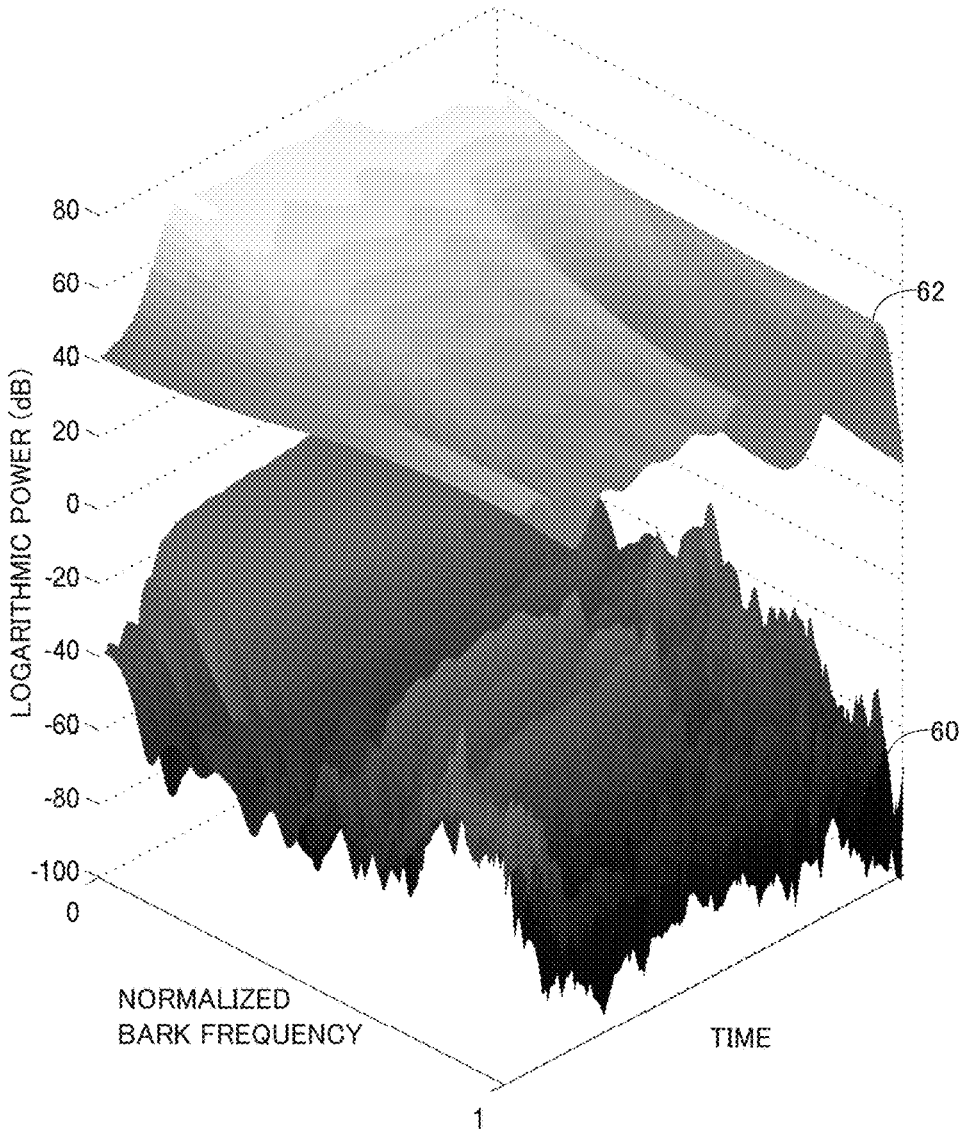
FIG. 2 is a graph showing a relation between speech spectrogram and envelope surface of the spectrogram used in an embodiment of the present invention.

FIG. 2 shows examples of speech spectrogram 60 and its envelope surface 62. In FIG. 2, envelope surface 62 is drawn 80 dB higher than the actual values for convenience, so as to facilitate viewing. Actually, these two are in such a relation that peaks of spectrogram 60 contact envelope surface 62 from below. In FIG. 2, the frequency axis is in Bark scale frequency, and the ordinate represents logarithmic power. By using perceptual or psycho-acoustic scale such as Mel scale, Bark scale or ERB scale, it becomes possible to extract an envelope surface with a high regard for spectrum in low frequency range, on which speech intelligibility much depends. Envelope surface 62 is taken to be a relatively moderate envelope relative to the variation of spectrogram 60 as mentioned above, and its change is more moderate in the time axis direction than in the frequency direction, as will be described later.

Consider, for a spectrogram $|X_{k,m}|^2$ (where k represents a position of frequency range on the frequency axis of the spectrogram as an object, and m represents position on the time axis of the spectrogram as an object, or a frame number), finding an envelope surface $X_{k,m}$ (here, "" represents a bar drawn over the character that immediately follows, in the equations shown below) in contact with the local peaks. Here, the following successive approximation is used.

The n-th approximation of the envelope surface is represented as $X_{k,m}^{(n)}$, and two-dimensional discrete inverse Fourier transform of its log is represented as $x_{u,v}^{(n)}$. The initial value $x_{u,v}^{(0)}$ is given by the following equation.

$$\bar{x}_{u,v}^{(0)} = \mathcal{F}^{-1}(\ln \bar{X}_{k,m}^{(0)}) = L_{u,v}\mathcal{F}^{-1}(\ln|X_{k,m}|^2) \tag{1}$$

where $L_{u,v}$ is a two-dimensional low-pass filter, of which details will be described in section 1.1.2.

The envelope surface is updated in accordance with the following equation.

$$\bar{x}_{u,v}^{(n)} = \bar{x}_{u,v}^{(n-1)} + \alpha L_{u,v}\mathcal{F}^{-1}(E_{k,m}^{(n-1)}) \ (\alpha \geq 1) \tag{2}$$

$$E_{k,m}^{(n)} = \begin{cases} \ln\dfrac{|X_{k,m}|^2}{\bar{X}_{k,m}^{(n)}} & \text{if } \dfrac{|X_{k,m}|^2}{\bar{X}_{k,m}^{(n)}} \geq 1, \\ 0 & \text{otherwise.} \end{cases}$$

where $\alpha$ is a coefficient for accelerating convergence.

For a prescribed value $\epsilon>0$, convergence is determined using the following equation, in which M and N represent the number of data points and the total number of frames of the spectrum, respectively.

$$\sum_{u=0}^{M-1}\sum_{v=0}^{N-1}|L_{u,v}\mathcal{F}^{-1}(E_{k,m}^{(n)})|^2 < \varepsilon \tag{3}$$

After the convergence, $X_{k,m}$ is given by $$\bar{X}_{k,m} \approx \begin{cases} \bar{X}_{k,m}^{(n)} & \text{if } \bar{X}_{k,m}^{(n)} > \bar{X}_{min}, \\ \bar{X}_{min} & \text{if } \bar{X}_{k,m}^{(n)} \leq \bar{X}_{min}. \end{cases} \tag{4}$$

where $X_{min}$ is a predetermined coefficient. By providing a lower limit $X_{min}$ of the envelope surface, it becomes possible to avoid the problem that silent portions with small power are emphasized to generate abnormal noise at the time of modifying the spectrogram.

<1.1.2 Envelope Surface Smoothing Two-Dimensional Filter>

In the present embodiment, the following equation is used for the term in Equations (1), (2) and (3).

$$L_{u,v} = \begin{cases} 1 & \text{if } |u| \leq \tau f_s \text{ and } |v| \leq \eta N T_f, \\ 0 & \text{otherwise.} \end{cases} \tag{5}$$

where $f_s$ represents sampling frequency of speech. $T_f$ represents frame period for analysis. N represents the total number of frames in a voice activity. By adjusting cut-offs $\gamma$, $\eta$ of the time (quefrency) domain and the frequency domain, the degree of smoothing in the frequency direction and the time direction of envelope surface can be changed, respectively.

Figure 3:
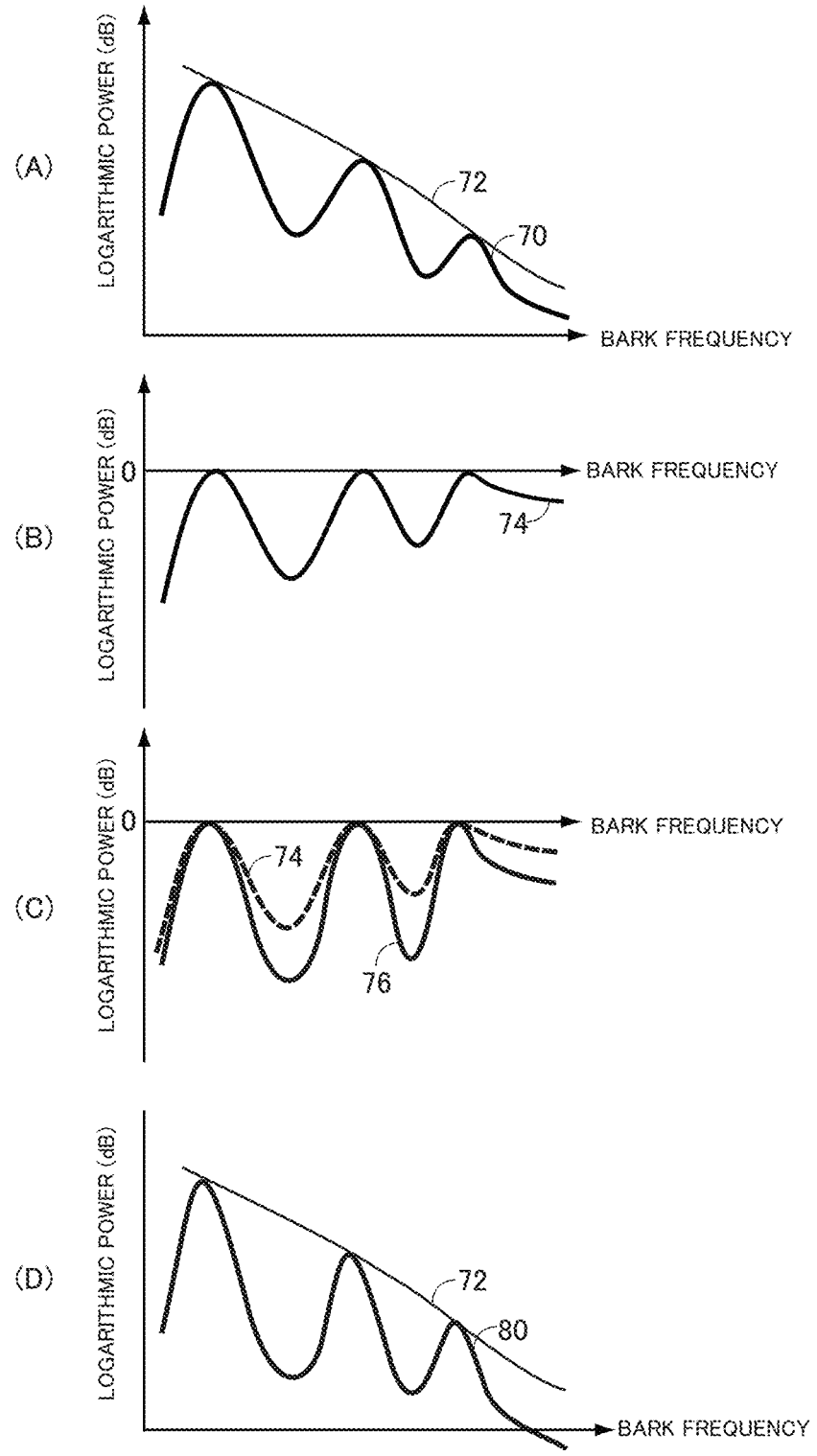
FIG. 3 includes graphs illustrating modifications of spectral distribution of a speech signal in accordance with an embodiment of the present invention.
Figure 4:
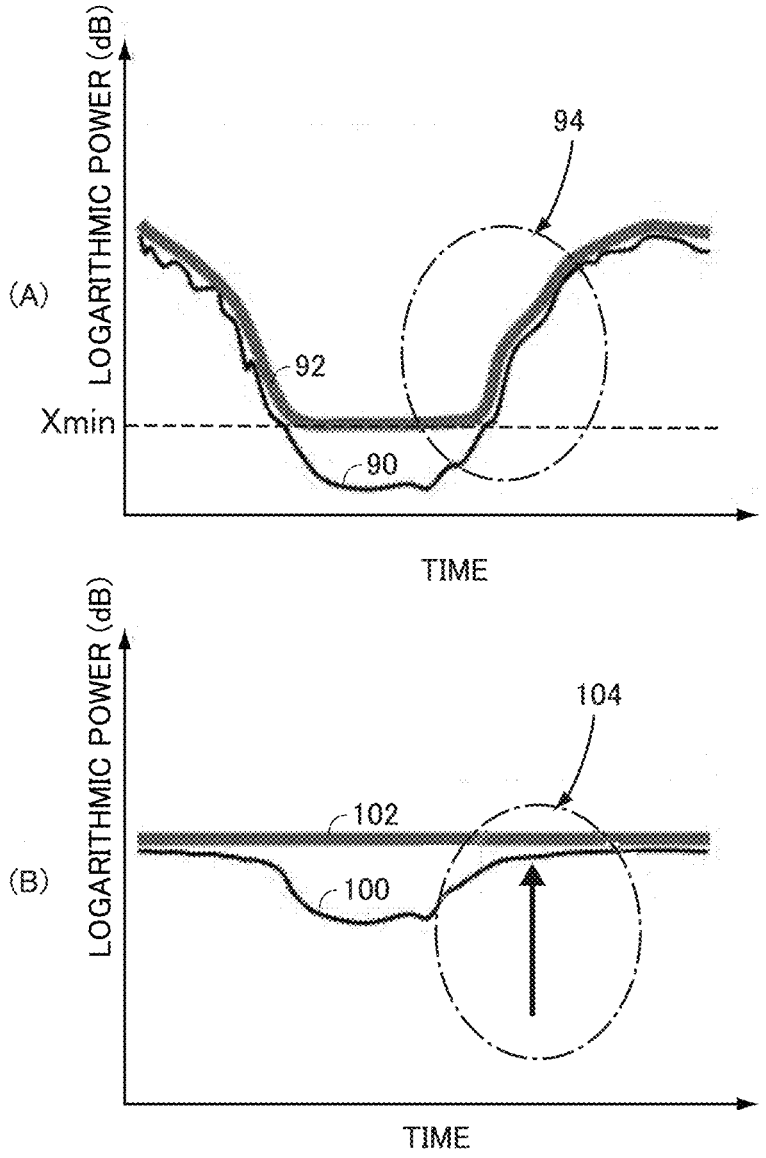
FIG. 4 includes graphs illustrating modifications of power variation at a specific frequency of speech signal spectrogram in accordance with an embodiment of the present invention.

An envelope surface 62 of FIG. 2, an envelope curve 72 of FIG. 3 and an envelope curve 92 of FIG. 4(A) are examples obtained in this manner. FIGS. 3 and 4 show curves of cross-sections in the frequency direction and the time direction of the envelope surface, respectively, and hence, these are referred to as envelope curves.

In the present embodiment, as will be described later, it is a precondition that the speech is a synthesized speech and known. Therefore, such an envelope surface can be calculated in advance. If the speech is unknown and given on real-time basis, an envelope surface similar to the above can be obtained in the following manner.

(1) Successively calculating an envelope curve of currently analyzed frame of the spectrum.

(2) Smoothing the time sequence of envelope curves obtained by the calculations in the time-axis direction, using a low-pass filter, for example.

<1.1.3 Noise Adaptation>

In order to adapt the envelope surface to noise, it is necessary to obtain noise spectrum. In the present embodiment, ambient noise is collected by a microphone, the power spectrum $|Y_{k,m}|^2$ thereof is successively calculated, and a spectrum $Y_{k,m}$ smoothed in the time direction is obtained by using, for example, a low-pass filter. In the present embodiment, this smoothing is realized in accordance with the following equation.

$$\bar{Y}_{k,m} = (1-\beta)\bar{Y}_{k,m-1} + \beta|Y_{k,m}|^2 \ (0<\beta<1) \tag{6}$$

Speech spectrogram $|X'_{k,m}|^2$ shaped in accordance with $Y_{k,m}$ (that is, noise-adapted) is given by the following equation. Here, emphasis of spectral peaks utilizing the envelope curve of speech spectrum is done simultaneously. This enhances formants and further improves intelligibility.

$$|X'_{k,m}|^2 = \underbrace{|X_{k,m}|^{2\gamma}(\bar{X}_{k,m})^{1-\gamma}}_{(a)}\underbrace{(D_{k,m})^{\zeta_m}}_{(b)} \tag{7}$$

$$D_{k,m} = \bar{Y}_{k,m} / \bar{X}_{k,m} \tag{8}$$

Equation (7) (a) represents formant enhancement ($\gamma>1$) with the envelope curve of spectrum unchanged, while (b) corresponds to a speech spectrum modifying operation that makes the envelope curve parallel to the smoothed noise spectrum.

Equation (7) (a) will be discussed in greater detail. Referring to FIG. 3(A), for a speech spectrogram (spectrum) 70 at a certain time point, its envelope curve is assumed to be an envelope curve 72. Equation (7) (a) can be represented as $$(a) = \overline{X}_{k,m}\left(\frac{|X_{k,m}|^2}{\overline{X}_{k,m}}\right)^{\gamma}$$

Natural logarithm of the equation above is as follows.

$$\text{Natural log of } (a) = \ln \overline{X}_{k,m} + \gamma(\ln|X_{k,m}|^2 - \ln \overline{X}_{k,m})$$

The portion in the parentheses of the second term in the equation above means that the value of envelope curve is subtracted from the spectrum value (logarithmic power). As a result, in a frame of which envelope curve is in contact with the spectrum, for example, spectrum 70 shown in FIG. 3(A) is modified to a curve 74 of FIG. 3(B). In FIG. 3(B), the logarithmic power value of the peak of curve 74 is substantially 0.

Further, by multiplying this value by $\gamma>1$ in log domain, the curve 74 is modified to a curve 76 shown in FIG. 3(C). This modification corresponds to emphasis of the peak portion by making deeper the trough portion of curve 74.

The first term of the equation above means adding $\ln X_{k,m}$ to the curve 76 shown in FIG. 3(C) in the log domain. As a result, the curve 76 of FIG. 3(C) moves upward by $\ln X_{k,m}$ along the log power axis. This results in a spectrum 80 shown in FIG. 3(D). The peak of spectrum 80 is in contact with the same envelope curve as envelope curve 72 shown in FIG. 3(A).

In Equation (8), $D_{k,m}$ represents a ratio between the smoothed spectrum of noise and the envelope curve of speech spectrum. This value is raised to $\alpha_m$-th power and multiplied by (a) as indicated by (b) of Equation (7) (in log domain, the difference between the smoothed spectrum of noise and the envelope curve of speech spectrum is multiplied by $\zeta_m$ and added to spectrum 80 of FIG. 3(D)). This is an operation to modify spectrum 80 shown in FIG. 3(D) such that the envelope curve of the spectrum becomes matches the smoothed spectrum of noise. Assuming that $\zeta_m=1$, for example, in log domain, it means that the envelope curve 72 is subtracted from spectrum 80 of FIG. 3(C) and the smoothed noise spectrum $Y_{k,m}$ of noise is added. In order to avoid extreme modification, however, $\zeta_m$ for a specific $\xi$ is defined as below.

$$\zeta_m = \begin{cases} 1 & \text{if } R_m \leqslant \xi \ (\xi \geqslant 0), \\ \dfrac{\xi}{R_m} & \text{otherwise.} \end{cases} \tag{9}$$

Here, $R_m$ represents degree of spectrum modification. In the present embodiment, $R_m$ is given by the following equation.

$$R_m = \frac{10}{M \ln 10}\sum_{k=0}^{M-1}(\ln D_{k,m} - d_m)^2 \tag{10}$$

-continued $$d_m = \frac{1}{M}\sum_{k=0}^{M-1}\ln D_{k,m}. \tag{11}$$

Figure 5:
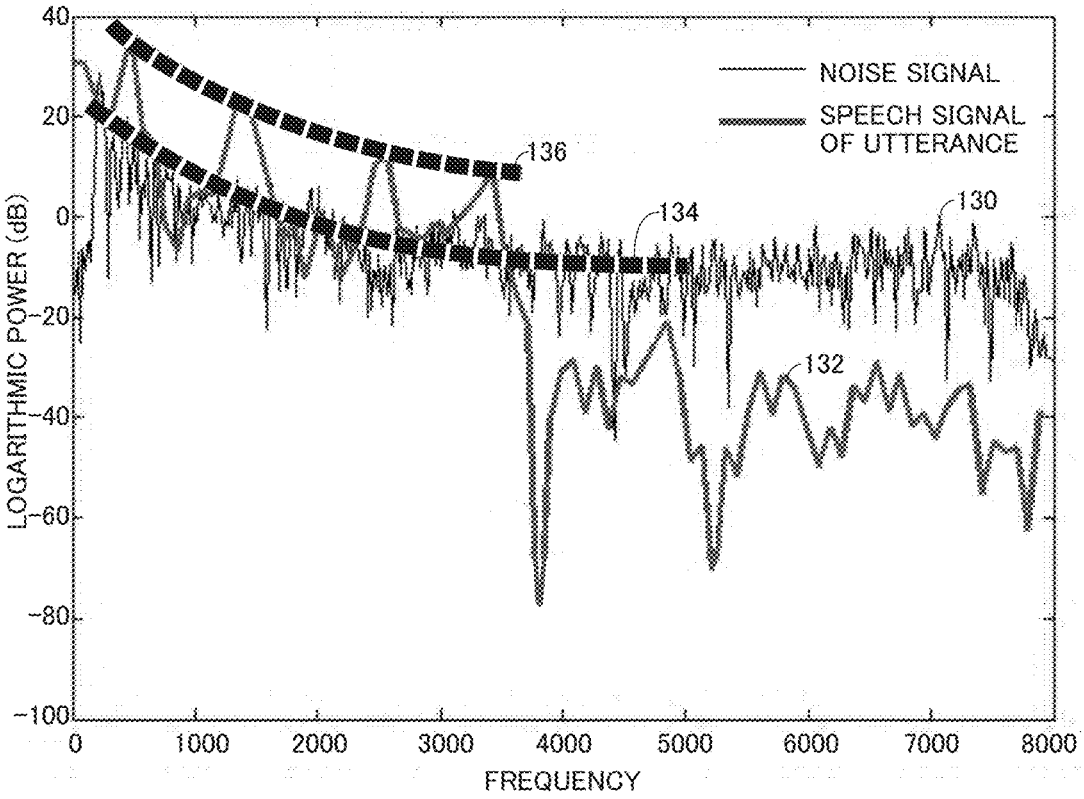
FIG. 5 is a graph illustrating a method of modifying spectral distribution envelope of a speech signal with noise-adaptation in an embodiment of the present invention.

FIG. 5 shows an example of power spectrum of speech obtained by the modification described above. In FIG. 5, it is assumed that a noise signal 130 has smoothed spectrum 134. The above-described intelligibility improving process is done on a synthesized speech signal for utterance and a speech signal 132 is obtained. From FIG. 5, we can see at first the effect attained by the use of Bark scale frequency when the envelope surface is extracted. Specifically, the speech spectrum is adapted to noise spectrum mainly in a relatively low frequency range, and particularly in the frequency band of 4000 Hz or lower that influences intelligibility, the power of peaks of formant and the like of speech signal 132 of utterance becomes higher than the noise spectrum. Next, it is noted that the envelope curve 136 of spectrum of the speech signal in this band is parallel to and positioned above the smoothed spectrum 134 of the noise signal. Thus, the speech is synthesized such that the formant portions of speech (spectrum peak) that have much influence on intelligibility stand out from the noise spectrum. As a result, clear speech that is easily intelligible even in a noisy environment can be generated.

In accordance with such a modification (in the frequency domain) of spectrum, Equation (7) realizes such a modification as shown in FIG. 4 on the variation of speech spectrogram in time direction. Referring to FIG. 4(A), for a cross-section 90 of a certain frequency of the spectrogram before the modification described above, assume that a cross-section at the same frequency of the envelope surface of the spectrogram is represented by an envelope curve 92. Further, assume that a transitional portion 94 from consonant to vowel exists at a portion having relatively low power of cross-section 90.

If noise is substantially steady and power spectrum thereof does not much change over time, modification to make flat the envelope curve 92 to match the noise is effected on cross-section 90 in the time direction of the spectrogram. As shown in FIG. 4(B), the spectrogram is modified such that an envelope curve 102 is made flat in the time-axis direction. In a time change 100 after modification, the shape of a transitional portion 104 corresponding to the transitional portion 94 from consonant to vowel shown in FIG. 4(A) is pushed upward to be in contact with envelope curve 102 from below. As a result, when a speech is synthesized based on the modified time change 100, the transitional section as an important clue in consonant perception will relatively amplified/emphasized, and the speech intelligibility can be improved.

On the other hand, coefficients of Equation (5) are set, for example, in the following manner. For the frequency direction, $\tau$ is set to $\tau$=125 μs so that the envelope curve moderately comes to be in contact only with the spectral peak. This corresponds to representing the envelope curve of each frame of speech sampled at 16 kHz, using up to the 2-nd order cepstrum. On the other hand, for the time direction, the envelope curve is made to follow the rise and fall as shown in FIG. 4(A) and $\eta$ is set to about 20 to about 40 Hz so that the transitional portion between consonant and vowel, for example, is emphasized as shown in (B) of the figure. Further, $\gamma$ is set to about $\gamma$=1.3 to emphasize formants.

<1.2 Thinning-Out of Harmonics and Energy Redistribution>

The above-described spectrum shaping improves intelligibility of speech even in a noisy environment. The present embodiment, however, aims to further enhance intelligibility by thinning out harmonics having only a slight influence on speech intelligibility, putting energy of the thinned-out harmonics on remaining harmonics and thereby increasing perceived volume and the intelligibility. Here, the number of harmonics to be left is limited to a prescribed number or smaller. For this purpose, sinusoidal wave synthesis is used for speech synthesis.

First, presence/absence of harmonics in a frequency range in which speech is buried in noise does not much influence how the speech is heard. Therefore, in the present embodiment, thinning-out synthesis of harmonics is not performed for such a time frequency that satisfies Equation (12) below with respect to a prescribed constant θ.

$$10\log_{10}\frac{|X'_{k,m}|^2}{\bar{Y}_{k,m}} < \theta \text{ (dB)} \tag{12}$$

If this coefficient θ is 0, of the modified speech signal, only those harmonic components having higher level than the smoothed spectrum of noise signal are synthesized, and other harmonic components are not synthesized. If the coefficient θ is positive, of the speech signal, only those harmonic components exceeding the level higher by θ in logarithmic power than the smoothed spectrum of noise signal are synthesized, and other harmonic components are not synthesized. If the coefficient θ is negative, only those harmonic components not lower than the level lower by the absolute value of θ in logarithmic power than the smoothed spectrum of noise signal are synthesized, and other harmonic components are not synthesized.

Further, in the present embodiment, even when the speech is not buried in noise, of the harmonics on both sides of a harmonic positioned closest to each formant frequency, one is not thinned-out and not synthesized. This is based on a principle similar to so-called masking. Specifically, the harmonics next to the harmonic positioned closest to the formants do not have much influence on hearing. If the harmonic components become too thin, perception of voice pitch becomes difficult, and this is the reason why one of the neighboring harmonics is synthesized and the other is not.

Figure 6:
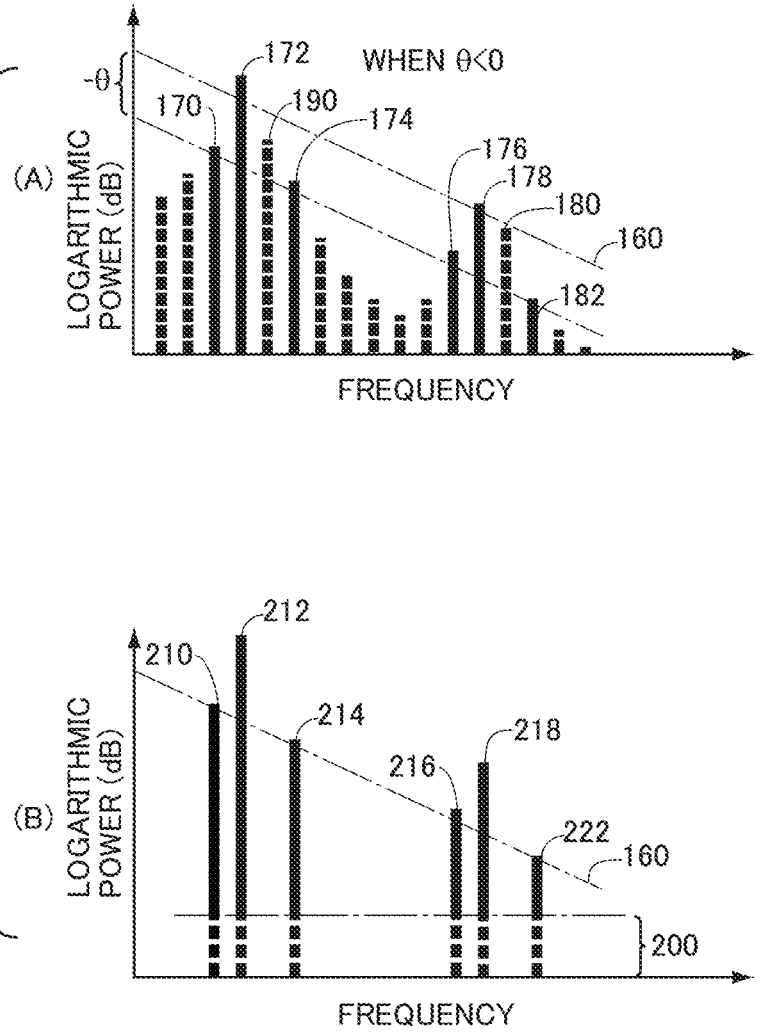
FIG. 6 includes graphs illustrating a method of boosting essential components using power of unnecessary harmonic components of a speech signal, in accordance with an embodiment of the present invention.

In an example shown in FIG. 6(A), assume that the smoothed spectrum of noise is as represented by spectrum 160. If θ<0, of the harmonic components shown in FIG. 6, harmonic components 170, 172, 190, 174, 176, 178, 180 and 182 only satisfy Equation (12). Therefore, only these are the objects of synthesis, and other harmonic components are not synthesized. Further, harmonic components 190 and 180, which are to be the objects of synthesis, are not synthesized, since these are next to harmonic components 172 and 178 forming the formants, respectively. Harmonic components 170 and 176 on the opposite sides, respectively, are left.

Further, energy of those harmonic components which are determined not to be synthesized is re-distributed to remaining harmonic components. As a result, energy 200 is re-distributed to harmonic components 170, 172, 174, 176, 178 and 182 shown in FIG. 6(A), and as a result, harmonic components 210, 212, 214, 216, 218 and 222 with power level increased are obtained as shown in FIG. 6(B). As a result, the remaining harmonic components come to have power still higher than the noise spectrum and, SN ratio is improved near the formants. Here, the total sum of energy of speech signal is unchanged and, therefore, physical sound volume is unchanged.

[2. Configuration]

Figure 7:
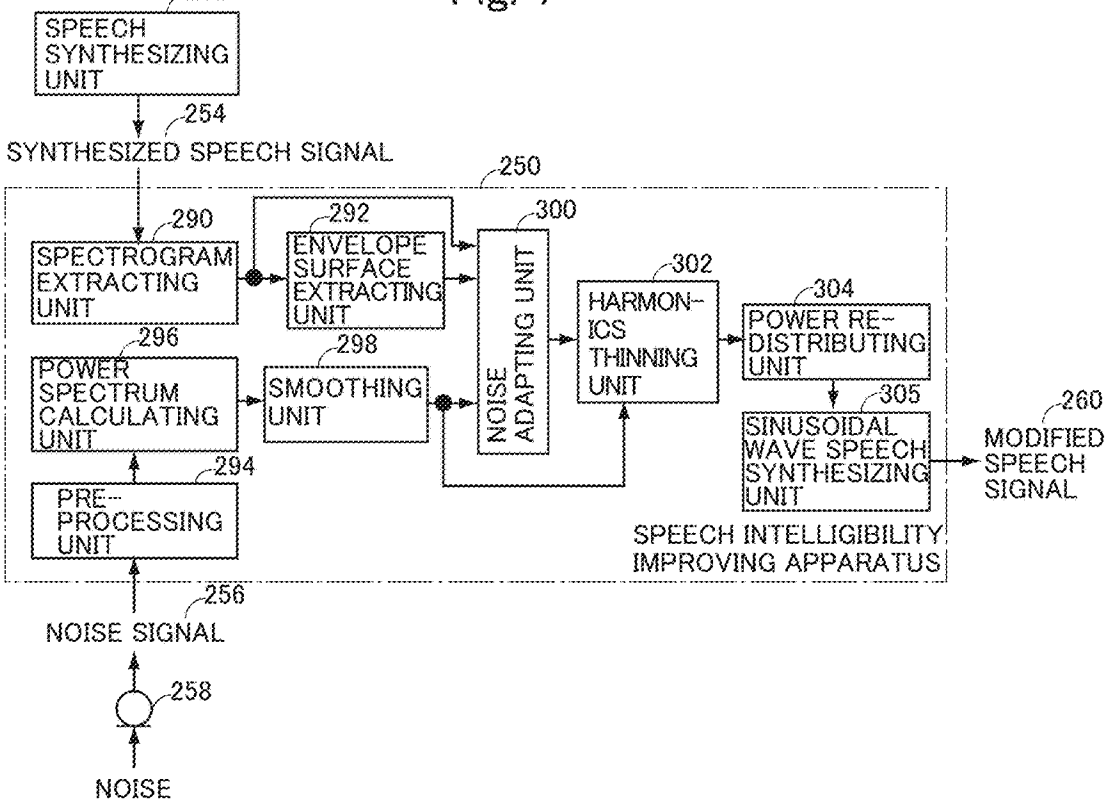
FIG. 7 is a functional block diagram of a speech intelligibility improving apparatus in accordance with an embodiment of the present invention.

The configuration of speech intelligibility improving apparatus in accordance with the present invention based on the principle above will be described in the following. Referring to FIG. 7, a speech intelligibility improving apparatus 250 in accordance with the present embodiment receives as inputs a synthesized speech signal 254 synthesized by a speech synthesizing unit 252 and a noise signal 256 representing ambient noise collected by a microphone 258, adapts synthesized speech signal 254 to noise signal 256, and thereby outputs a modified speech signal 260 that is more intelligible than the speech given by synthesized speech signal 254.

Speech intelligibility improving apparatus 250 includes: a spectrogram extracting unit 290 receiving synthesized speech signal 254 and extracting its spectrogram $|X_{k,m}|^2$; and an envelope surface extracting unit 292 extracting, based on the spectrogram $|X_{k,m}|^2$ extracted by spectrogram extracting unit 290, the envelope surface $|X_{k,m}|$ thereof. Extraction of spectrogram by spectrogram extracting unit 290 can be realized by existing technique. Extraction of envelope surface by envelope surface extracting unit 292 uses the technique described in sections 1.1.1 and 1.1.2. This process can be realized by computer hardware and software, or by a dedicated hardware. Here, it is realized by computer hardware and software. When a synthesized speech provided by speech synthesizing unit 252 is used as the object of modification as in the present embodiment, most of the spectrogram extraction and envelope surface extraction may be done beforehand by calculation, since the speech signal is known in advance.

Speech intelligibility improving apparatus 250 further includes: a pre-processing unit 294 performing pre-processing such as digitization and framing on noise signal 256 received from microphone 258 and outputting a noise signal consisting of a series of frames; a power spectrum calculating unit 296 extracting power spectrum from the framed noise signal output from pre-processing unit 294; a smoothing unit 298 smoothing time change of the power spectrum of noise signal extracted by power spectrum calculating unit 296, and thereby outputting a smoothed spectrum $Y_{k,m}$ at time $mT_f$ (m-th frame) of the noise signal; a noise adapting unit 300 performing noise adaptation process described in section 1.1.3 above based on the spectrogram $|X_{k,m}|^2$ of synthesized speech output from spectrogram extracting unit 290, the envelope surface $|X_{k,m}|$ of the synthesized speech output from envelope surface extracting unit 292 and smoothed spectrum $Y_{k,m}$ of the noise signal output from smoothing unit 298, and outputting harmonic components obtained by sampling, at an interval of fundamental frequency of the speech, the spectrum $|X'_{k,m}|^2$ at time $mT_f$ of the adapted speech signal; a harmonic thinning unit 302 performing level comparison between each harmonic output from noise adapting unit 300 and the smoothed spectrum $Y_{km}$ of noise and thinning out harmonics lower than a prescribed level (that is, SN ratio) in accordance with Equation (12) and thinning out one of the harmonics on opposite sides of the harmonic positioned closest to each formant frequency; a power re-distributing unit 304 uniformly re-distributing the power of thinned-out harmonic components to each of the harmonic components left after the thinning by harmonic thinning unit 302; and a sinusoidal speech synthesizing unit 305 synthesizing a speech from the remaining harmonics that received power re-distributed by power re-distributing unit 304. The output from sinusoidal speech synthesizing unit 305 is the modified speech signal 260, which is adapted to noise and has improved intelligibility. It is needless to say that the process of sampling the spectrum $|X'_{k,m}|^2$ at the interval of fundamental frequency of speech by noise adapting unit 300 and the process of thinning out harmonics not having much influence on speech perception in a noisy environment by harmonics thinning unit 302 are applied only in a voiced section in which the speech has harmonic components.

[3. Operation]

Speech intelligibility improving apparatus 250 operates in the following manner. Receiving an instruction of generating a speech, not shown, speech synthesizing unit 252 performs speech synthesis, outputs synthesized speech signal 254 and applies it to spectrogram extracting unit 290. Spectrogram extracting unit 290 extracts a spectrogram from synthesized speech signal 254, and applies it to envelope surface extracting unit 292 and noise adapting unit 300. Envelope surface extracting unit 292 extracts, from the spectrogram received from spectrogram extracting unit 290, an envelope surface and applies it to noise adapting unit 300.

Microphone 258 collects ambient noise, converts it to noise signal 256 as an electric signal, and applies it to pre-processing unit 294. Pre-processing unit 294 digitizes the noise signal 256 received from microphone 258 frame by frame, each frame having a prescribed frame length and prescribed shift length, and applies the resulting signal as a series of frames to power spectrum calculating unit 296. Power spectrum calculating unit 296 extracts power spectrum from the noise signal received from pre-processing unit 294, and applies the power spectrum to smoothing unit 298. Smoothing unit 298 smoothes time sequence of the spectrum by filtering, and thereby calculates smoothed spectrum of noise, which is applied to noise adapting unit 300.

Noise adapting unit 300 performs noise adaptation process on the spectrogram applied from spectrogram extracting unit 290 in accordance with the method described above, using the envelope surface of the spectrogram of synthesized speech 254 applied from envelope surface extracting unit 292 and the smoothed spectrum of noise signal applied from smoothing unit 298, outputs harmonic components obtained by sampling the spectrum $|X'_{k,m}|^2$ at each time after adaptation at the interval of fundamental frequency of speech, and applies the output to harmonics thinning unit 302.

Harmonics thinning unit 302 compares each harmonic output from noise adapting unit 300 with the smoothed spectrum of noise signal output from smoothing unit 298, performs the harmonics thinning process described above, and outputs only the remaining harmonics. Power re-distributing unit 304 re-distributes power of thinned-out harmonics to each harmonic of spectrogram after thinning output by thinning unit 302 and thereby raises the levels of remaining harmonics, and thus, outputs modified speech signal 260.

Because of the principle described above, the synthesized speech noise-adapted by noise adapting unit 300 has spectrum peaks emphasized and spectral feature at the transitional portions of speech emphasized. Further, its peak is adapted to the noise level and, hence, the speech intelligible even in a noisy environment can be generated. Further, harmonics thinning unit 302 thins out harmonics not having influence on intelligibility, and power re-distributing unit 304 re-distributes the power to remaining harmonics. As a result, only those portions of the speech which have influence on intelligibility come to have higher power while the total acoustic power is not changed. As a result, easily intelligible speech can be generated without unnecessarily increasing the sound volume.

[4. Computer Implementation]

The above-described speech intelligibility improving apparatus 250 can substantially be realized by computer hardware and a computer program or programs co-operating with the computer hardware. Here, programs executing the processes described in sections 1.1.1, 1.1.2 and 1.1.3 may be used for envelope surface extracting unit 292 and noise adapting unit 300.

<Hardware Configuration>

Figure 8:
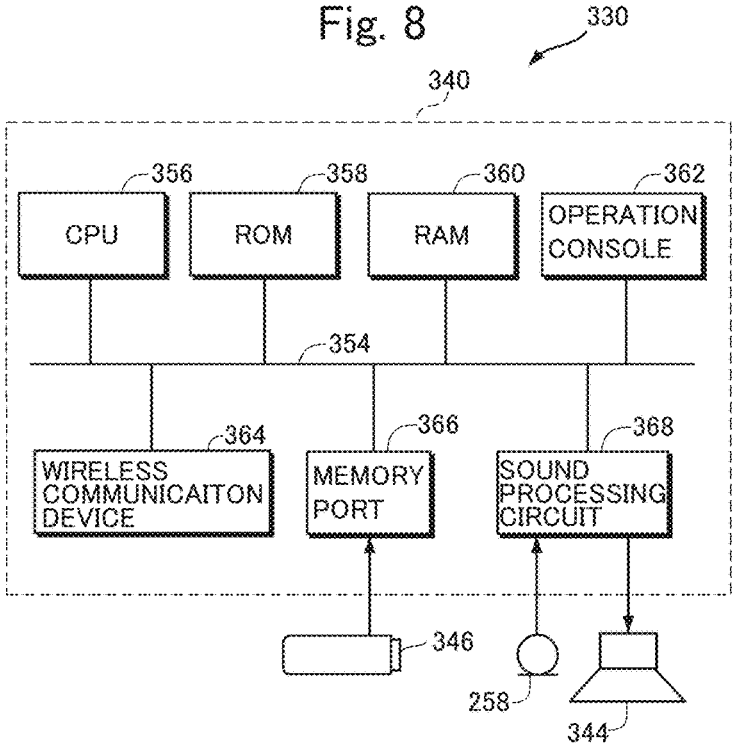
FIG. 8 is a hardware block diagram of a computer implementing the speech intelligibility improving apparatus shown in FIG. 7.

FIG. 8 shows an internal configuration of a computer system 330 realizing speech intelligibility improving apparatus 250 described above.

Referring to FIG. 8, computer system 330 includes a computer 340, and microphone 258 and a speaker 344 connected to computer 340.

Computer 340 includes: a CPU (Central Processing Unit) 356; a bus 354 connected to CPU 356; a re-writable read only memory (ROM) 358 storing a boot-up program and the like; a random access memory (RAM) 360 storing program instructions, a system program and work data; an operation console 362 used, for example, by a maintenance operator; a wireless communication device 364 allowing communication with other terminals through radio wave; a memory port 366 to which a removable memory 346 can be attached; and a sound processing circuit 368 connected to microphone 258 and speaker 344, for performing a process of digitizing speech signals from microphone 258 and a process of analog-converting digital speech signals read from RAM 360 and applying the result to speaker 344.

A computer program causing computer system 330 to function as speech intelligibility improving apparatus 250 in accordance with the above-described embodiment is stored in advance in a removable memory 346. After the removable memory 346 is attached to memory port 366 and a rewriting program of ROM 358 is activated by operating operation console 362, the program is transferred to and stored in ROM 358. Alternatively, the program may be transferred to RAM 360 by wireless communication using wireless communication device 364 and then written to ROM 358. At the time of execution, the program is read from ROM 358 and loaded to RAM 360.

The program includes a plurality of instructions to cause computer 340 to operate as various functional units of speech intelligibility improving apparatus 250 in accordance with the above-described embodiment. Some of the basic functions necessary to realize the operation may be dynamically provided at the time of execution by the operating system (OS) running on computer 340, by a third party program, or by various programming tool kits or a program library installed in computer 340. Therefore, the program may not necessarily include all of the functions necessary to realize speech intelligibility improving apparatus 250 in accordance with the above-described embodiment. The program has only to include instructions to realize the functions of the above-described system by dynamically calling appropriate functions or appropriate program tools in a program tool kit from storage devices in computer 340 in a manner controlled to attain desired results. Naturally, the program only may provide all the necessary functions.

In the present embodiment shown in FIGS. 2 to 7, the speech signal or the like is applied from microphone 258 to sound processing circuit 368, digitized by sound processing circuit 368 and stored in RAM 360, and processed by CPU 356. The modified speech signal obtained as a result of processing by CPU 356 is stored in RAM 360. When CPU 356 instructs sound processing circuit 368 to generate a speech, sound processing circuit 368 reads the speech signal from RAM 360, analog-converts the same and applies the result to speaker 344, from which the speech is generated.

The operation of computer system 330 executing a computer program is well known and, therefore, description thereof will not be given here.

As described above, by the speech intelligibility improving apparatus 250 in accordance with the above-described present embodiment, when a speech is to be generated in a noisy environment, the speech signal representing the speech to be generated can be modified both along the time-axis and the frequency-axis simultaneously based on the acoustic characteristics of noise, whereby the speech can be heard with high intelligibility even in a noisy environment. At the time of modifying the speech signal, when formant peak is to be emphasized, only the portion or portions having influence on hearing are emphasized and, therefore, unnecessary increase in the sound volume is avoided.

Further, the spectrum shaping technique in accordance with the present embodiment takes into consideration the importance of speech spectrum peaks such as formants in speech perception, and performs dynamic range compression with respect to time change of spectrum having close relation to speech perception. In this regard, this technique is much different from conventional approaches.

The embodiment described above is directed to an apparatus for generating a synthesized speech in a noisy environment. The present invention, however, is not limited to such an embodiment. It is needless to say that the present invention is applicable to modify actual speech of fresh voice to be more intelligible over noise, when the actual speech is to be transmitted over a speaker. In this situation, if it is possible, the actual speech should preferably be processed not on fully real-time basis but with a delay of some time. By doing so, it becomes possible to obtain the envelope surface of speech spectrogram for a longer time period and, hence, it becomes possible to modify the speech more effectively.

Further, in the above-described embodiment, when the power of those portions of speech signal which are buried in noise are to be re-distributed to portions having influence on hearing, one of the two harmonics on opposite sides of the harmonics positioned closest to a peak such as a formant is the object of deletion. The present invention, however, is not limited to such an embodiment. Both of the two may be deleted, or both may not be deleted.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

INDUSTRIAL APPLICABILITY

The present invention is applicable to devices and equipment for reliably transmitting information by speech in a possibly noisy environment both indoors and outdoors.

REFERENCE SIGNS LIST

30,250 speech intelligibility improving apparatus
32, 132 speech signal
34 modified speech signal
40 filtering unit
42 dynamic range compressing unit
60 spectrogram
62 envelope surface
70, 80 spectrum (spectrogram)
72, 92, 102, 136, 134 envelope curve
130 noise signal
256 noise signal
258 microphone
260 modified speech signal
290 spectrogram extracting unit
296 power spectrum calculating unit
292 envelope surface extracting unit
298 smoothing unit
300 noise adapting unit
302 harmonics thinning unit
304 power re-distributing unit
305 sinusoidal speech synthesizing unit
330 computer system
340 computer
344 speaker

The invention claimed is:

1. A speech intelligibility improving apparatus for generating an intelligible speech, comprising:

peak general outline extracting means for extracting, from a spectrum of a speech signal as an object, a general outline of peaks represented by a curve along a plurality of local peaks of a spectral envelope of the spectrum;

spectrum modifying means for modifying the spectrum of said speech signal based on the general outline of peaks extracted by the peak general outline extracting means; and speech synthesizing means for generating a speech based on the spectrum modified by said spectrum modifying means, wherein said spectrum modifying means includes ambient sound spectrum extracting means for extracting a spectrum from an ambient sound collected in an environment to which the speech is to be transmitted or in a similar environment, and means for modifying a spectrum of said speech signal based on said general outline of peaks extracted by said peak general outline extracting means and the ambient sound spectrum extracted by said ambient sound spectrum extracting means.

2. The speech intelligibility improving apparatus according to claim 1, wherein said peak general outline extracting means extracts, from a spectrogram of a speech signal as an object, a curved surface along a plurality of local peaks of an envelope of the spectrogram in time/frequency domain, and obtains said general outline of peaks at each time from the extracted curved surface.

3. The speech intelligibility improving apparatus according to claim 1, wherein said peak general outline extracting means extracts said general outline of peaks based on perceptual or psycho-acoustic scale of frequency.

4. The speech intelligibility improving apparatus according to claim 1, wherein said spectrum modifying means includes spectrum peak emphasizing means for emphasizing a peak of said speech signal, based on said general outline of peaks extracted by said peak general outline extracting means.

5. A computer program embodied on a non-transitory computer-readable medium, causing, when executed by a computer, the computer to function as all means described in claim 1.

6. The speech intelligibility improving apparatus according to claim 2, wherein said peak general outline extracting means extracts said general outline of peaks based on perceptual or psycho-acoustic scale of frequency.

7. A computer program embodied on a non-transitory computer-readable medium, causing, when executed by a computer, the computer to function as all means described in claim 2.

8. A computer program embodied on a non-transitory computer-readable medium, causing, when executed by a computer, the computer to function as all means described in claim 3.

9. A computer program embodied on a non-transitory computer-readable medium, causing, when executed by a computer, the computer to function as all means described in claim 4.

* * * * *